US009079193B2

(12) United States Patent
Klintenstedt

(10) Patent No.: US 9,079,193 B2
(45) Date of Patent: Jul. 14, 2015

(54) CENTRIFUGAL SEPARATOR HAVING AN ELASTIC CONNECTION

(75) Inventor: Kjell Klintenstedt, Saltsjö-Boo (SE)

(73) Assignee: Alfa Laval Corporate AB, Lund (SE)

( * ) Notice: Subject to any disclaimer, the term of this patent is extended or adjusted under 35 U.S.C. 154(b) by 1149 days.

(21) Appl. No.: 13/063,561

(22) PCT Filed: Sep. 21, 2009

(86) PCT No.: PCT/SE2009/051043

§ 371 (c)(1),
(2), (4) Date: May 19, 2011

(87) PCT Pub. No.: WO2010/033075

PCT Pub. Date: Mar. 25, 2010

(65) Prior Publication Data

US 2011/0212820 A1 Sep. 1, 2011

(30) Foreign Application Priority Data

Sep. 22, 2008 (SE) ..... 0802010

(51) Int. Cl.
*B04B 1/08* (2006.01)
*B04B 9/04* (2006.01)
(Continued)

(52) U.S. Cl.
CPC ... *B04B 9/04* (2013.01); *B04B 1/08* (2013.01); *B04B 9/08* (2013.01); *B04B 9/12* (2013.01); *B04B 11/02* (2013.01)

(58) Field of Classification Search
CPC ..... B04B 11/02; B04B 9/04; B04B 9/08; B04B 9/12; B04B 1/08
USPC ..... 494/43, 46, 67–73, 82–84; 464/179–180
See application file for complete search history.

(56) References Cited

U.S. PATENT DOCUMENTS 1,745,853 A 10/1926 Krantz
4,759,744 A 7/1988 Krook
(Continued)

FOREIGN PATENT DOCUMENTS

CN 1098336 A 2/1995
DE 202005001539 6/2006
(Continued)

OTHER PUBLICATIONS

Office Action dated Jun. 22, 2012, issued in conjunction with corresponding Russian Application No. 2011115812, pp. 1-7, providing a concise English language summary of SU 1567280A1 and RU 43198U1.
(Continued)

*Primary Examiner* — Charles Cooley
(74) *Attorney, Agent, or Firm* — MKG, LLC

(57) ABSTRACT

In a centrifugal separator having a stationary part, a non-rotating part, is elastically connected to the stationary part, and a rotating part, rotates around an axis of rotation and comprises a centrifuge rotor and a rotating bearing-receiving element. The centrifuge rotor comprises a disk package with a plurality of separating disks. The rotating part is journalled in the non-rotating part so that the rotating part and the non-rotating part are commonly pivotable relative to the stationary part. A drive arrangement drives the rotating part about the axis of rotation within a range of revolutions. An inlet channel extends into the inner separation space for feeding of a medium to be separated. An outlet channel extends out from the inner separation space for discharge of a separated product. The bearing-receiving element is tubular. At least one of the inlet channel and the outlet channel extends through the bearing-receiving element.

16 Claims, 2 Drawing Sheets

(51) Int. Cl.

| | |
|---|---|
| ***B04B 9/12*** | (2006.01) |
| ***B04B 11/02*** | (2006.01) |
| ***B04B 9/08*** | (2006.01) |

(56) References Cited

U.S. PATENT DOCUMENTS

| | | | | |
|---|---|---|---|---|
| 6,338,708 | B1 * | 1/2002 | Miura et al. | 494/82 |
| 6,960,158 | B2 | 11/2005 | Mackel | |
| 6,988,980 | B2 * | 1/2006 | Moss | 494/15 |
| 8,092,362 | B2 * | 1/2012 | Kohlstette et al. | 494/82 |
| 8,182,408 | B2 * | 5/2012 | Isaksson et al. | 494/70 |
| 8,758,209 | B2 * | 6/2014 | Mackel et al. | 494/15 |
| 8,845,505 | B2 * | 9/2014 | Mackel et al. | 494/15 |
| 2005/0065010 | A1 * | 3/2005 | Moss | 494/15 |
| 2009/0186752 | A1 * | 7/2009 | Isaksson et al. | 494/40 |
| 2009/0253565 | A1 * | 10/2009 | Kohlstette et al. | 494/12 |
| 2009/0280974 | A1 | 11/2009 | Klintenstedt | |
| 2011/0212820 | A1 * | 9/2011 | Klintenstedt | 494/46 |
| 2013/0130885 | A1 * | 5/2013 | Klintenstedt | 494/60 |
| 2014/0235422 | A1 * | 8/2014 | Isaksson et al. | 494/41 |

FOREIGN PATENT DOCUMENTS

| | | | |
|---|---|---|---|
| GB | 2277700 | A | 11/1994 |
| JP | 9-506031 | A | 6/1997 |
| RU | 43198 | U1 | 1/2005 |
| SE | 507107 | | 3/1998 |
| SU | 1194504 | | 11/1985 |
| SU | 1567280 | A1 | 5/1990 |
| WO | 9515820 | | 6/1995 |
| WO | 2007104684 | A1 | 9/2007 |
| WO | 2007125066 | | 11/2007 |
| WO | 2007133161 | | 11/2007 |
| WO | 2008013495 | A1 | 1/2008 |
| WO | WO 2013034495 | A2 * | 3/2013 |
| WO | 2014/072318 | A2 * | 5/2014 |

OTHER PUBLICATIONS

Office Action and Search Report from Chinese Application No. 200980138124.3, dated Oct. 17, 2012.

Japanese Office Action for corresponding Japanese Application No. 2011-527780 dated Mar. 21, 2013.

International Preliminary Report on Patentability and Written Opinion for PCT/SE2009/051043, dated Mar. 22, 2011.

* cited by examiner

CENTRIFUGAL SEPARATOR HAVING AN ELASTIC CONNECTION

FIELD OF THE INVENTION

The present invention refers to a centrifugal separator.

BACKGROUND

A centrifugal separator according to the following description is known and comprises a stationary part forming a base, non-rotating part, which comprises a bracket and which is elastically connected to the stationary part by means of an elastic connection, and a rotating part which is configured to rotate around an axis of rotation and comprises a centrifuge rotor. The centrifuge rotor comprises a rotor casing, which forms an inner separation space, and a rotating bearing-receiving element in the form a spindle. The centrifuge rotor comprises a disk package with a plurality of separating disks. The rotating part is journalled in a stiff manner in the non-rotating part in such a way that the rotating part and the non-rotating part are commonly pivotable in relation to the stationary part by means of the elastic connection. A drive arrangement drives the rotating part to rotate around the axis of rotation within a range of revolutions, which extends from zero to a highest number of revolutions per minute and which comprises at least one operating number of revolutions. An inlet channel extends into the inner separation space for feeding of a medium to be separated. An outlet channel, which is fixedly attached to the stationary part, extends out from the inner separation space for discharge of a separated product.

Another similar separator is also known wherein the stator of the drive motor is fixedly connected to the stationary part.

Historically, centrifugal separators have typically been designed with a relatively long and thin spindle, which permits the centrifuge rotor to pivot or oscillate laterally. All centrifugal separators have a number of critical numbers of revolutions at which such pivoting or lateral deflection, of the centrifuge rotor arises. It is desirable to drive centrifugal separators at relatively high rotation rates for achieving an efficient separation. These desired rotational rates are normally higher than at least the first critical rotational rate. When initiating a separation process, the first critical rotational rate thus has to be passed. Stable operation is achieved within a range of rotational rates above the first critical rotational rate.

Centrifugal separators of a conventional kind also have a limitation with regard to how high the centrifuge rotor and the disk package provided therein can be made. This limitation depends at least partly on the relation of the moments of inertia of the centrifuge rotor, i.e. between the polar moment of inertia of the centrifuge rotor and the diametrical moments of inertia of the centrifuge rotor. If this relation of moments of inertia is too small it is difficult to achieve a stable operation. It would be desirable to be able to make the centrifuge rotor higher in spite of the limitation formed by the relation of moments of inertia, since then more separating disks can be provided and the separation capacity can be increased.

SUMMARY OF THE INVENTION

The present invention resides in one aspect in a centrifugal separator which can be manufactured with a relatively high centrifuge rotor and which can be operated in a stable manner. Furthermore, it is aimed at a construction which can be modified and adapted to centrifuge rotors with different heights.

In an embodiment of the present invention, a centrifugal separator includes a tubular bearing-receiving element and that at least one of an inlet channel and an outlet channel extends through the bearing-receiving element. Such a tubular bearing-receiving element may have a high stiffness at the same time as an access from one end of the separation space can be achieved. The relatively stiff bearing-receiving element in combination with the non-rotating part, which due to the elastic connection is permitted to pivot with the centrifuge rotor and the bearing-receiving element and form a relatively large co-pivoting mass, permits a stable operation, and in particular a rotor dynamic stable operation, with a relatively high centrifuge rotor and a relatively high disk package.

According to an embodiment of the invention, the inlet channel is connected in a stiff manner to and comprised by the non-rotating part. The inlet channel may extend through the tubular bearing-receiving element thereby forming a part of the co-pivoting mass.

According to a further embodiment of the invention, the outlet channel is connected in a stiff manner to and comprised by the non-rotating part. The outlet channel may extend through the tubular bearing-receiving element. Also the outlet channel thus forms a part of the co-pivoting mass. Due to the fact that the inlet and outlet channels extend through the bearing-receiving element, all connections to the centrifuge rotor and the inner separation space may extend in the same direction. Consequently, only one opening through the rotor casing is needed, which means that the construction can be readily adapted to disk packages with different heights. Since the inlet and outlet channels comprise or form part of the non-rotating part, which are specifically provided in the bearing-receiving element and stiff per se, or substantially stiff, relative pivoting movements between the rotor casing on the one hand and the inlet and outlet channels on the other hand may be avoided.

According to a further embodiment of the invention, the bearing-receiving element is stiff and configured to maintain a constant straight extension being parallel with the axis of rotation within the whole range of revolutions.

According to a further embodiment of the invention, the disk package has an outer diameter D and the bearing-receiving element an inner diameter d, and wherein d/D is larger than or equal to 0.2.

According to a further embodiment of the invention, the disk package has an outer diameter D and height H, and wherein H/D is larger than or equal to 0.8.

According to a further embodiment of the invention, the rotating part comprises two critical frequencies, which both derive from said pivotability in a radial direction in relation to the stationary part, and wherein the operating rotational rate is higher than the two critical frequencies. There are different conditions for achieving only two critical frequencies within the range of revolutions. These conditions include at least some of the following conditions, the rotating part is journalled in a stiff manner in the non-rotating part, that the rotating part can not move axially in relation to the non-rotating part, that the rotating part and the non-rotating part can not oscillate axially in relation to the stationary part, and that the rotating part and the non-rotating part can not turn (torsion oscillation) around the axis of rotation in relation to the stationary part. When the rotating part has passed these two critical frequencies and reached the operating rotational rate, i.e. the desired revolutions per minute at which the centrifugal separator is to be operated for an efficient separation, a rotor dynamic stable operation is achieved.

According to a further embodiment of the invention, the non-rotating part has a moment of inertia $J_I$ with respect to a transversal axis, which extends substantially perpendicular to the axis of rotation and through a common centre of gravity for the rotating part and the non-rotating part, wherein the rotating part has a diametrical moment of inertia $J_R$ with respect to the transversal axis and a polar moment of inertia $J_P$ with respect to the axis of rotation, and wherein $1,1*J_P$ is less than $J_R+J_I$.

According to a further embodiment of the invention, the non-rotating part has a mass $m_I$, and the rotating part has a mass $m_R$, wherein $m_I/m_R$ is larger than or equal to 0.1.

According to a further embodiment of the invention, the drive arrangement comprises an electric motor. Advantageously, the electric motor may comprise a rotor and a stator which is comprised by the non-rotating part. Furthermore, the rotor may be comprised by and provided on the rotating part. It is also possible to let the drive arrangement also comprise a power transmission element, wherein the power transmission element is in engagement with a drive wheel, which is comprised by and provided on the rotating part, and arranged to transmit a drive force from the electric motor to the drive wheel.

According to a further embodiment of the invention, the centrifugal separator comprises a protecting cover which is comprised by the stationary part and which encloses the centrifuge rotor.

According to a further embodiment of the invention, the non-rotating part comprises a carrying element, wherein the centrifugal separator comprises a bearing arrangement which is comprised by the rotating part and the non-rotating part and which is provided between and connected to the bearing-receiving element and the carrying element, and wherein the carrying element, the bearing arrangement and the bearing-receiving element form a stiff unit. Advantageously, the stator may be provided on, and connected in a stiff manner to, the carrying element.

BRIEF DESCRIPTION OF THE DRAWINGS

The present invention is now to be explained more closely by means of a description of various embodiments and with reference to the drawings attached hereto.

DETAILED DESCRIPTION OF VARIOUS EMBODIMENTS OF THE INVENTION

Figure 1:
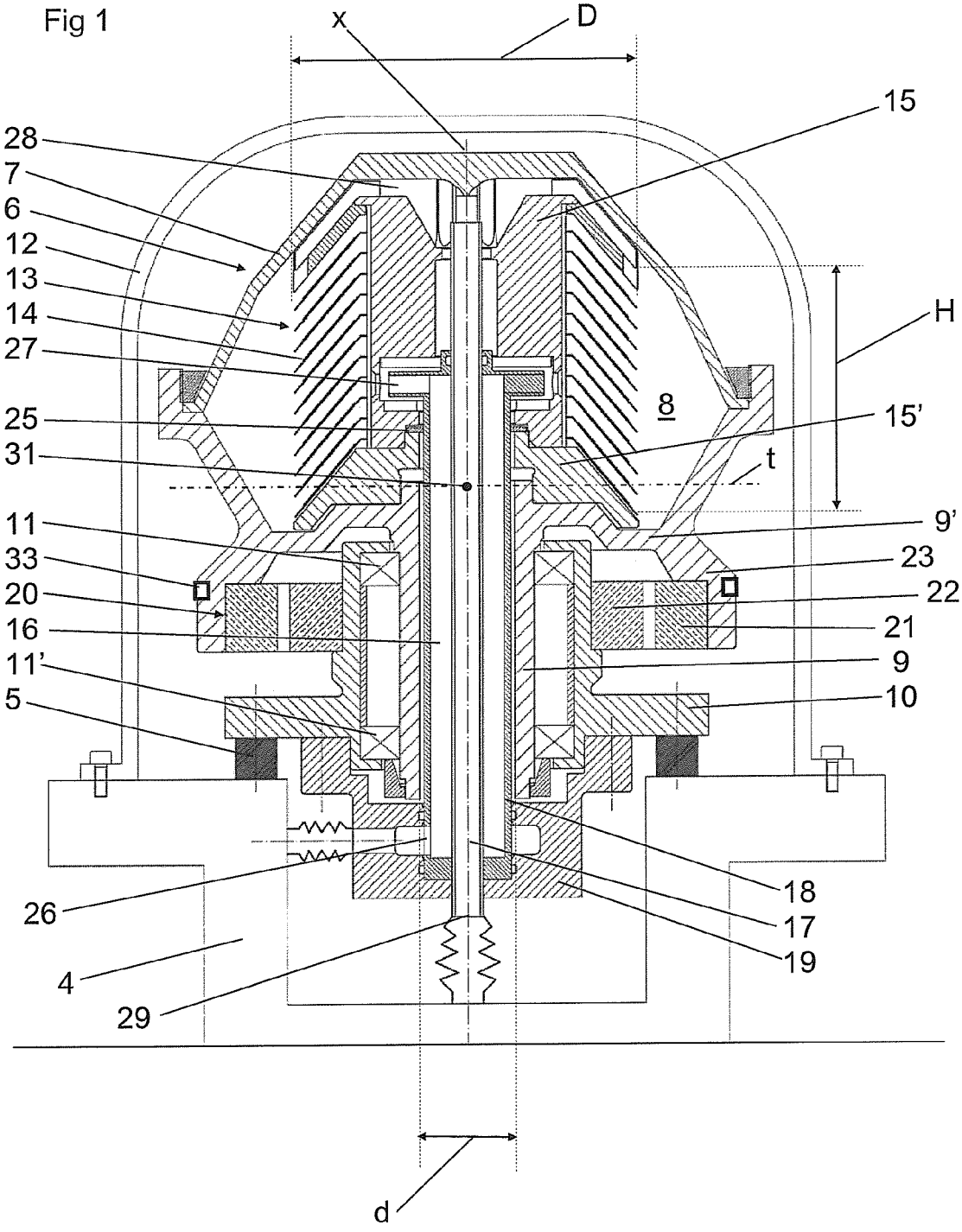
FIG. 1 discloses a sectional view of a first embodiment of a centrifugal separator according to the invention.

FIG. 1 discloses a centrifugal separator which comprises or consists of a stationary part, a non-rotating part and a rotating part.

The stationary part forms a base 4 which is located on a ground, for instance a floor. The non-rotating part is elastically connected to the stationary part, i.e. to the base 4, by means of an elastic connection 5. The elastic connection 5 may comprise a number of elastic elements, which have elastic and dampening properties, or any form of active damping elements. The elastic elements are disposed around the axis x of rotation and, in the embodiments disclosed, in an annular configuration. The rotating part is configured to rotate around an axis x of rotation and comprises a centrifuge rotor 6. The elastic connection 5, i.e. the elastic elements or any other active damping elements, are configured in such a way that the rotating part and the non-rotating part may pivot or oscillate in relation to the stationary part and in such a way that the rotating part and the non-rotating part are prevented from oscillating axially or turning around the axis x of rotation, i.e. torsion oscillations are to be prevented.

The rotating part is journalled in a stiff manner in the non-rotating part in such a way that the rotating part and the non-rotating part are commonly pivotable in relation to the stationary part by means of the elastic connection 5.

The centrifuge rotor 6 comprises a rotor casing 7 which defines an inner separation space 8. The centrifuge rotor 6 also comprises a rotating bearing-receiving element 9. The bearing-receiving element 9 forms or corresponds to a spindle of the centrifugal separator. The bearing-receiving element 9 thus extends along or in parallel with the axis x of rotation. Furthermore, the bearing-receiving element 9 is tubular and forms a passage extending along or in parallel with the axis x of rotation. The bearing-receiving element 9 is connected to an upper outwardly projecting, or radially projecting, part 9' to which the rotor casing 7 is connected. In the embodiments disclosed the bearing-receiving element 9 and the outwardly projecting part 9' are designed in one piece. Furthermore, the outwardly projecting part 9' and the rotor casing 7 of the centrifuge rotor 6 are designed as two separate parts which are fixedly connected to each other.

The non-rotating part comprises a carrying element 10. As can be seen in FIG. 1, the elastic connection 5, i.e. the elastic elements, are provided between the carrying element 10 and the base 4. Furthermore, a bearing arrangement, comprising one, two or several bearings 11, 11', is provided between and comprised by the rotating part and the non-rotating part. In the embodiments disclosed, the bearing arrangement comprises a first bearing 11 and a second bearing 11', which are provided between and connected to the bearing-receiving element 9 and the carrying element 10. The carrying element 10, the bearing arrangement 11, 11' and the bearing-receiving element 9 form a stiff unit where the bearing-receiving element 9 is permitted to rotate in relation to the carrying element 10.

The centrifugal separator also comprises a protecting cover 12 which is comprised by the stationary part and which encloses or surrounds the centrifuge rotor 6. The protecting cover 12 is in the embodiments disclosed attached to the base 4.

The centrifuge rotor 6 comprises a disk package 13, which comprises a plurality of separating disks 14, a distributor 15 and a distributor support 15'. The separating disks 14 may be conical as in the embodiments disclosed or have any other suitable shape for the actual application. The disk package 13 rests on the projecting part 9' of the bearing-receiving element 9. The disk package 13 and its separating disks 14 are compressed between the projecting part 9' and the rotor casing 7.

The disk package 13 has an outer diameter D, which corresponds to the outer diameter of each separating disk 14 in a radial direction with regard to the axis x of rotation, and a height H, which extends in parallel with the axis x of rotation from the outer edge of the lowermost separating disk 14 to the outer edge of the uppermost separating disk 14 in the disk package 13. The disk package 13 may have a relatively large height in relation to its diameter, which means that H/D can be larger than or equal to 0.8, preferably larger than or equal to 1, more preferably larger than or equal to 1.5. Consequently, the disk package 13 may also in comparison with conventional centrifugal separators have a large height. The bearing-receiving element 9 has an inner diameter d of the passage extending in parallel with axis x of rotation. The inner diameter d is relatively large, especially in relation to the outer diameter D of the disk package 13, i.e. d/D is larger than or equal to 0.2.

Furthermore, the centrifugal separator comprises an inlet channel 16, which extends into the inner separation space 8 for feeding of a medium to be separated, and at least one outlet channel 17, which extends out from the inner separation space 8 for discharge of a separated product. It is possible to provide the centrifugal separator with several outlet channels for discharge of different separated products in a manner known per se. The centrifugal separator may also comprise openings or nozzles, known per se, for discharge of sludge. The inlet channel 16 and the outlet channel 17 are fixedly connected to the carrying part 10. In the embodiments disclosed, the inlet channel 16 and the outlet channel 17 are housed as separate channels in a common pipe 18 extending through the bearing-receiving element 9, i.e. in the above mentioned passage, in parallel with the axis x of rotation, and are fixedly connected to the carrying part 10 via holding element 19.

Furthermore, the centrifugal separator comprises a drive arrangement for driving the rotating part to rotate around the axis x of rotation within a range of revolutions from zero to a highest number of revolutions per minute, for instance 10,000 revolutions per minute, preferably 12,000 per minute. The rotating part is operating at at least an operating number of revolutions which lies within said range of revolutions. In the first embodiment, the drive arrangement comprises an electric motor 20 with a rotor 21, which is comprised by and provided on the rotating part, and a stator 22, which is comprised by the non-rotating part. The stator 22 is in the embodiments disclosed provided inside the rotor 21 and on the carrying element 10. The rotor 21 is provided on a rotating support member 23, which is rotary symmetric and fixedly connected to, or configured in one piece with the bearing-receiving element 9, and more precisely with, the projecting part 9' forming a part of, or connected to, the bearing-receiving element 9.

The inlet channel and the outlet channel 17 are per se stiff, or substantially stiff, within the range of revolutions. Furthermore, the inlet channel 16 and the outlet channel 17 are connected to the non-rotating part in a stiff, or substantially stiff, manner in such a way that the inlet channel 16 and the outlet channel 17 are comprised by the non-rotating part. This stiff, or substantially stiff, connection is obtained in the embodiments disclosed by means of the common pipe 18 and the holding element 19. This stiff, or substantially stiff, connection contributes to the inlet channel 16 and the outlet channel 17 forming a part of the co-pivoting mass, i.e. they may pivot together with the rotating and the non-rotating parts in relation the stationary part.

The bearing-receiving element 9 is tubular and surrounds or encloses the inlet channel 16 and the outlet channel 17, which thus extend along the axis x of rotation through the bearing-receiving element 9. Both the inlet channel 16 and the outlet channel 17 are thus comprised by the non-rotating part. At least one seal 25, for instance a labyrinth seal, is provided between the bearing-receiving element 9 and the inlet and outlet channels 16, 17. In the embodiments disclosed, the sealing 25 is provided between the bearing-receiving element 9 and the pipe 18 which encloses the inlet and outlet channels 16, 17. Due to the fact that the bearing-receiving element 9 is tubular, this element 9 may be stiff and configured to maintain a constant straight extension which is parallel with the axis x of rotation within the entire range of revolutions.

The inlet channel 16 comprises a first opening 26, which is located outside the inner separation space 8 and the bearing-receiving element 9, and a second opening 27 which is located in the inner separation space 8. The outlet channel 17 comprises a first opening 28, which is located in the inner separation space 8, and a second opening 29, which is located outside the inner separation space 8 and the bearing-receiving element 9. The first opening 28 of the outlet channel 17 may be designed as a paring member known per se for discharge of the separated product from the outlet channel 17.

The rotating part has a mass $m_R$ and the non-rotating part has a mass $m_I$. The rotating part and the non-rotating part have a common centre of gravity 31. The mass relation for the rotating part and the non-rotating part $m_I/m_R$ is larger than or equal to 0.1. At least partly depending on the fact that non-rotating part has a relatively large mass in relation to the rotating part, and the fact that the non-rotating part is provided to pivot together with the rotating part in relation to the stationary part, a stable operation is achieved within the whole range of revolutions. It is to be noted that the positioning of the masses in relation to each other and the common centre of gravity also is important for achieving a rotor dynamic stable operation. This is reflected in the conditions defined below for the different moments of inertia. Furthermore, the rotating part may comprise a balance ring 33 which is provided on the rotating part and concentric to the axis x of rotation. Such a balance ring 33 is known per se and contributes further to a stable operation of the centrifugal separator.

The non-rotating part also has a moment of inertia $J_I$ with respect to a transversal axis t, which extends perpendicular to the axis x of rotation and through the common centre of gravity 31 for the rotating part and the non-rotating part. The rotating part has a diametrical moment of inertia $J_R$ with respect to the transversal axis t and a polar moment of inertia $J_P$ with respect to the axis x of rotation. The sum of the diametrical moment of inertia $J_R$ and the moment of inertia $J_I$ is to be larger than the polar moment of inertia $J_P$, and more precisely according to the relation $1{,}1*J_P$ is less than $J_R+J_I$.

The rotating part comprises at least two critical numbers of revolutions. These two critical numbers of revolutions derive from the above mentioned pivotability or deflection of the centrifuge rotor in relation to the stationary part. The operating number of revolutions is higher than these two critical numbers of revolutions. When the centrifuge rotor is operating at such an operating number of revolutions, a rotor dynamic stable operation is achieved. It is to be noted that there may be several critical numbers of revolutions. With the structure defined according to the invention, where the rotating part is journalled in a stiff manner in the non-rotating part and may not move axially in relation to the non-rotating part, and where the rotating and non-rotating parts, as a unit or co-pivoting mass, may not oscillate axially or turn around the axis x of rotation, as mentioned above, critical numbers of revolutions, which derive from an axial movement of the rotating part may, however, be eliminated, or substantially eliminated.

Figure 2:
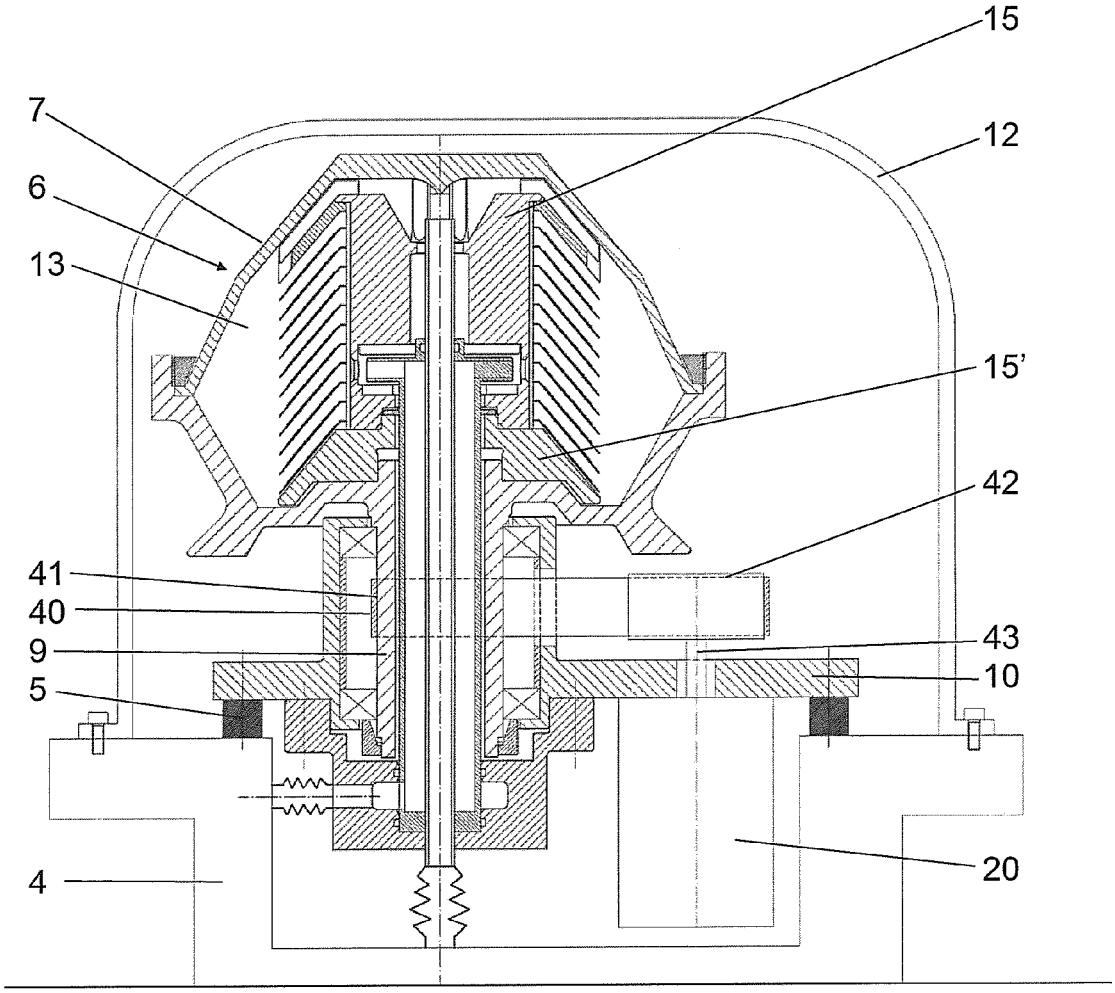
FIG. 2 discloses a sectional view of a second embodiment of a centrifugal separator according to the invention.

FIG. 2 discloses a second embodiment which differs from the first embodiment in that the drive arrangement comprises an electric motor 20 which is not concentric to the centrifuge rotor but provided laterally with regard to the bearing-receiving element 9. The drive arrangement also comprises a power transmission element 40, which in the second embodiment comprises a drive belt. The power transmission element may also be realised in other ways, for instance through a gear box. The power transmission element 40 is in engagement with a drive wheel 41, which is comprised by and provided on the rotating part, and more precisely on the bearing-receiving element 9, and a drive wheel 42 which is provided on a drive shaft 43 of the electric motor 20. The power transmission member 40 is arranged to transmit a drive force from the electric motor 20 and the drive wheel 42 to the drive wheel 41 and the rotating part. As can be seen in FIG. 2, the electric motor 20 is provided on the carrying element 10 and thus forms a part of the non-rotating part and a part of the co-pivoting mass. It is to be noted that the drive arrangement may comprise two, three or several motors 20, which via a respective power transmission member 40 acts on the drive wheel 41.

It is to be noted that the drive arrangement can be designed in other ways than disclosed in the two embodiments. For instance the rotating part may be driven by means of an electric motor where the drive force is transmitted via a universal coupling. In such a drive arrangement, the axis of rotation of the electric motor may possibly be concentric to the axis x of rotation. Furthermore, it is possible to move the rotor 21 and the stator 22 in the first embodiment to another position. For instance these elements may be provided beneath the bearings 11 and 11'. As an alternative to an electric motor, hydraulic and/or pneumatic driving may be utilised.

The invention is not limited to the embodiments disclosed but may be modified and varied in the scope of the following claims.

What is claimed is:

1. A centrifugal separator comprising a stationary part forming a base configured to be located on a ground, a non-rotating part, which is elastically connected to the stationary part by means of an elastic connection, a rotating part, which is configured to rotate around an axis of rotation and comprises a centrifuge rotor, which comprises a rotor casing forming an inner separation space, and a rotating bearing-receiving element, wherein the centrifuge rotor comprises a disk package having a plurality of separating disks and wherein the rotating part is journalled in a stiff manner in the non-rotating part in such a way that the rotating part and the non-rotating part form a common pivot unit that is in pivotable communication with the stationary part by means of the elastic connection, a drive arrangement for driving the rotating part to rotate around the axis of rotation within a range of revolutions, which is from zero to a highest number of revolutions per minute and which comprises at least an operating number of revolutions, the drive arrangement comprising an electric motor, the electric motor comprising a rotor and a stator, the rotor being coupled to the rotating part and the stator being comprised of the non-rotating part, an inlet channel, which extends into the inner separation space for feeding of a medium to be separated, at least an outlet channel, which extends out from the inner separation space for discharge of a separated product, the bearing-receiving element being tubular and at least one of the inlet channel and the outlet channel extends through the bearing-receiving element.

2. A centrifugal separator according to claim 1, wherein the inlet channel is connected in a stiff manner to and comprised by the non-rotating part.

3. A centrifugal separator according to claim 2, wherein the inlet channel extends through the tubular bearing-receiving element.

4. A centrifugal separator according to claim 1, wherein the outlet channel is connected in a stiff manner to and comprised by the non-rotating part.

5. A centrifugal separator according to claim 4, wherein the outlet channel extends through the tubular bearing-receiving element.

6. A centrifugal separator according to claim 1, wherein the bearing-receiving element is stiff and configured to maintain a constant straight extension being parallel with the axis of rotation within the whole range of revolutions.

7. A centrifugal separator according to claim 1, wherein the disk package has an outer diameter D and the bearing-receiving element an inner diameter d, and wherein D/d is larger than or equal to 0.2.

8. A centrifugal separator according to claim 1, wherein the disk package has an outer diameter D and a height H and wherein H/D is larger than or equal to 0.8.

9. A centrifugal separator according to claim 1, wherein the rotating part comprises two critical frequencies, which both derive from said pivotability in a radial direction in relation to the stationary part, and wherein the operating rotation rate is higher than the two critical frequencies.

10. A centrifugal separator according to claim 1, wherein the non-rotating part has a moment of inertia $J_I$ with respect to a transversal axis, which extends perpendicular to the axis of rotation and through a common centre of gravity for the rotating part and the non-rotating part, wherein the rotating part has a diametrical moment of inertia $J_R$ with respect to the transversal axis and a polar moment of inertia $J_P$ with respect to the axis of rotation, and wherein $1{,}1*J_P$ is less than $J_R+J_I$.

11. A centrifugal separator according to claim 1, wherein the non-rotating part has a mass $m_I$, and the rotating part has a mass $m_R$, wherein $m_I/m_R$ is larger than or equal to 0.1.

12. A centrifugal separator according to claim 1, wherein the rotor is comprised by and provided on the rotating part.

13. A centrifugal separator according to claim 1, wherein the centrifugal separator comprises a protecting cover which is comprised by the stationary part and which encloses the centrifuge rotor.

14. A centrifugal separator according to claim 1, wherein the non-rotating part comprises a carrying element, wherein the centrifugal separator comprises a bearing arrangement which is comprised by the rotating part and the non-rotating part and which is provided between and connected to the bearing-receiving element and the carrying element, and wherein the carrying element, the bearing arrangement and the bearing-receiving element form a stiff unit.

15. A centrifugal separator according to claim 14, wherein the stator is provided on the carrying element.

16. A centrifugal separator according to claim 1, wherein the non-rotating part comprises a carrying element and the stator is provided on the carrying element.

* * * * *